US009763507B2

(12) United States Patent
Sze

(10) Patent No.: US 9,763,507 B2
(45) Date of Patent: Sep. 19, 2017

(54) USER-ADJUSTABLE HEADBAND AND METHOD OF MANUFACTURE THEREOF

(71) Applicant: Tung Hing Plastic Manufactory Ltd., Kowloon (HK)

(72) Inventor: Ka Chuen Sze, Kowloon (HK)

(73) Assignee: Tung Hing Plastic Manufactory Ltd., Kowloon (HK)

( * ) Notice: Subject to any disclaimer, the term of this patent is extended or adjusted under 35 U.S.C. 154(b) by 0 days.

(21) Appl. No.: 14/327,719

(22) Filed: Jul. 10, 2014

(65) Prior Publication Data

US 2016/0007710 A1 Jan. 14, 2016

(51) Int. Cl.
*A45D 8/36* (2006.01)

(52) U.S. Cl.
CPC ..... *A45D 8/36* (2013.01)

(58) Field of Classification Search
CPC ..... A45D 8/36; A45D 8/14; A45D 2/2442; Y10T 24/4465; Y10T 24/44034; A44C 5/00; A44C 5/0053
USPC ..... 132/273, 222, 246, 207; 24/303.5 T, 27, 24/20 R, 22
See application file for complete search history.

(56) References Cited

U.S. PATENT DOCUMENTS

2008/0283082 A1* 11/2008 Jagemann ..... A45D 8/36 132/275
2009/0032050 A1* 2/2009 Defenbaugh ..... A45D 8/36 132/273
2009/0090378 A1* 4/2009 Chudzik ..... A45D 8/36 132/273
2009/0183751 A1* 7/2009 Tu ..... A45D 8/36 132/273
2009/0194130 A1* 8/2009 Defenbaugh ..... B82Y 10/00 132/273
2012/0125360 A1* 5/2012 Hill ..... A45D 8/36 132/275
2012/0260935 A1* 10/2012 Lalonde ..... A45D 8/00 132/275

FOREIGN PATENT DOCUMENTS

CN 2292435 Y 9/1998
CN 203554654 U 4/2014
JP 56-137923 A 10/1981

* cited by examiner

*Primary Examiner* — Todd E Manahan
*Assistant Examiner* — Brianne Kalach
(74) *Attorney, Agent, or Firm* — Heslin, Rothenberg, Farley & Mesiti, P.C.

(57) ABSTRACT

There is provided a headband for managing hair of a user comprising an elongate body member defining a full length and configured to be conformable around the head of a user, wherein the body member includes a first layer potion, a second layer portion connected to the first layer portion and an elongate metallic core member arranged between the first and second layer portions, and wherein, in use, when the headband resembling an arch is worn by the user the first layer portion is positioned to be outwardly facing and the second layer is positioned to be inwardly facing, and wherein the body member is user-adjustable in curvature such that the full length of the arch is conformable to specific contour of the head and entire inwardly facing surface of the second layer portion of the member is engageable around the head.

16 Claims, 16 Drawing Sheets

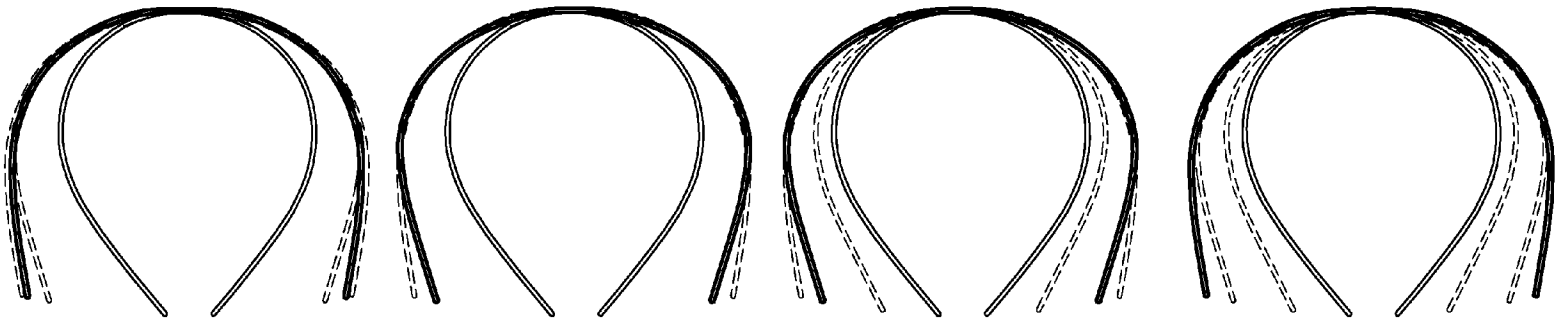
Fig. 7a
Fig. 7b
Fig. 7c
Fig. 7d
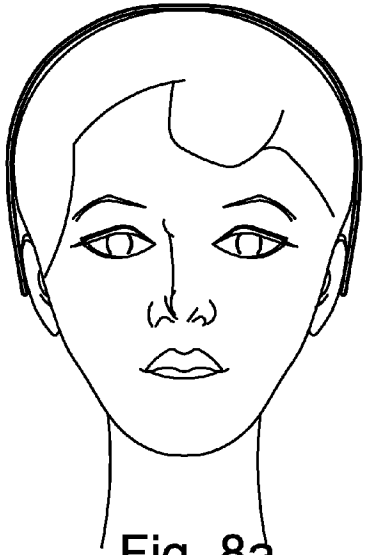
Fig. 8a
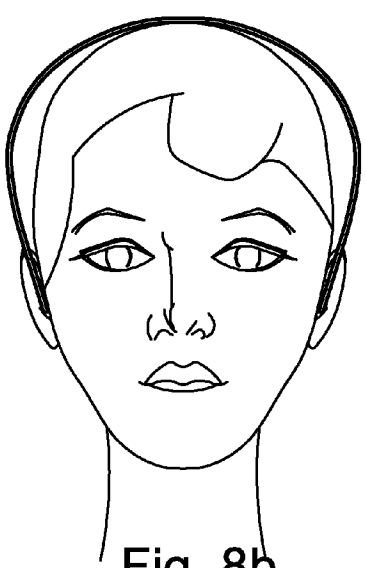
Fig. 8b
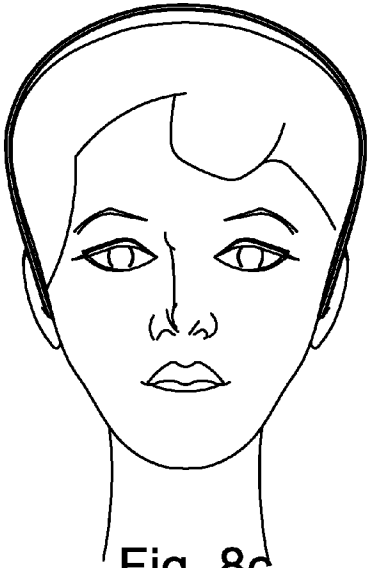
Fig. 8c
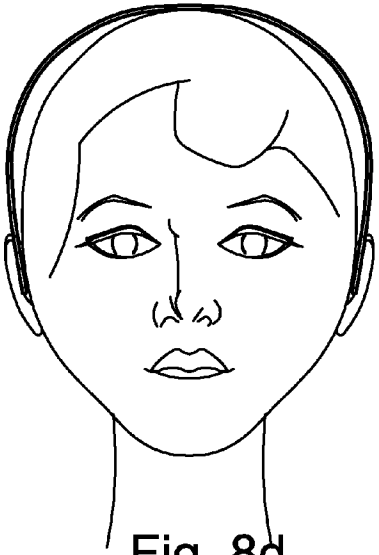
Fig. 8d

2

USER-ADJUSTABLE HEADBAND AND METHOD OF MANUFACTURE THEREOF

FIELD OF THE INVENTION

The present invention is concerned with a user adjustable headband, and a method of manufacture thereof.

BACKGROUND OF THE INVENTION

There are a variety of accessories on the market for hair management. For example, there are different types of clipping devices such as barrettes and hair claws for securing hair. There are also different types of elastic hair loops for managing hair. Headbands resembling an arch have also been used to manage and secure hair. While a conventional headband is useful to some extent because it can be worn or removed conveniently, it is often unable to tailor to different users. As such, the conventional headband may either be too tight to be comfortable or too loose to secure hair reliably.

The present invention seeks to address these problems or at least to provide an alternative to the public.

SUMMARY OF THE INVENTION

According to a first aspect of the present invention, there is provided a headband for managing hair of a user comprising an elongate body member defining a full length and configured to be conformable around the head of a user, wherein the body member includes a first layer potion, a second layer portion connected to the first layer portion and an elongate metallic core member arranged between the first and second layer portions, and wherein, in use, when the headband resembling an arch is worn by the user the first layer portion is positioned to be outwardly facing and the second layer is positioned to be inwardly facing, and wherein the body member is user-adjustable in curvature such that the full length of the arch is conformable to specific contour of the head and entire inwardly facing surface of the second layer portion of the member is engageable around the head.

Preferably, the headband may be configured to allow the user to program the elongate member such that magnitude of pressure from different regions of the full length of the body member on the head is user-adjustable.

Suitably, the first layer portion may have a flexural strength from substantially 36-72 MPa, and the metallic core member may have a flexural strength from substantially 560-930 MPa. Studies leading to the present invention show that this combination of flexural strengths can unexpectedly produce desired effects of sufficient resilience and stiffness and conforming capability to the head of the user.

In one embodiment, the body member may have a length from substantially 320-400 mm, or specifically substantially 320-360 mm and substantially 360-400 mm.

The first layer portion may be made from a material substantially stiffer or with flexural strength significantly lower than that of the second layer material.

The first layer portion may be made from a first material selected from the group consisting of acrylonitrile butadiene styrene (ABS), polypropylene (PP), polyethylene (PE), nylon, polycarbonate (PC), acrylonitrile styrene (AS), polyoxymethylene (POM), general purpose polystyrene (GPPS), high impact polystyrene (HIPS), acrylic, cellulose acetate and thermoplastic elastomer (TPE).

The second layer portion may be made of or coated with an anti-slipping material for enhancing gripping of hair in use.

The second layer may be made from a second material selected from the group consisting of thermoplastic elastomer (TPE), thermoplastic polyurethane (TPU), polyurethane (PU), silicone, natural rubber and ethylene vinyl acetate (EVA).

The metallic core member may be made from a material selected from a group including steel, brass, aluminium, copper, tin and an alloy material.

According to a second aspect of the present invention, there is provided a method of manufacture of a headband as described above.

Preferably, the method may comprise steps in sequential order of:

a) providing the elongate metallic core member;
b) positioning the elongate metallic core member on a mould in a moulding machine;
c) overmoulding a or the first material on the elongate metallic core member for forming a first assembly of the first layer portion and the metallic core member, the first assembly defining a first surface acting as an outwardly facing surface of the headband in use and a second surface; and
d) overmoulding a or the second material on the elongate metallic core member on the second surface over the metallic core member for forming a second assembly of the first layer portion, the metallic core member and the second layer portion, the second assembly defining a third surface acting as the inwardly facing surface of the headband in use.

The steps of overmoulding the first material and overmoulding the second material may occur in one moulding machine.

According to a third aspect of a method of manufacture of a headband, comprising steps in sequential order of:

a) providing an elongate metallic core member;
b) connecting the metallic core member and a first layer portion together thus forming a first assembly, the first assembly defining a first or outwardly facing surface and a second surface;
c) connecting the first assembly and a second layer portion thus forming a second assembly, the second assembly defining a third surface acting an inwardly facing surface.

Preferably, the first metallic core member and the first layer portion may be connected together adhesively. The first assembly and the second layer portion may be connected together adhesively.

Alternatively, the first assembly may be formed by positioning the metallic core member on a mould in a moulding machine, overmoulding a first material on the metallic core member for forming the first assembly, and overmoulding a second material on the metallic core member for forming the second assembly.

In preferred embodiments, the member may have a length from substantially 320 to 400 mm, or specifically substantially 320-360 mm or 360-400 mm.

In one preferred embodiment, the first layer portion may have a flexural strength from substantially 36-72 MPa, and the metallic core member may have a flexural strength from substantially 560-930 MPa.

The first layer portion may be made from a first material selected from the group consisting of acrylonitrile butadiene styrene (ABS), polypropylene (PP), polyethylene (PE), nylon, polycarbonate (PC), Acrylonitrile Styrene (AS), polyoxymethylene (POM), general purpose polystyrene (GPPS), high impact polystyrene (HIPS), acrylic, cellulose acetate and thermoplastic elastomer (TPE).

The second layer portion may be made of an anti-slipping material for enhancing gripping of hair of user in use.

The second layer may be made from a second material selected from the group consisting of thermoplastic elastomer (TPE), thermoplastic polyurethane (TPU), polyurethane (PU), silicone, natural rubber and ethylene vinyl acetate (EVA).

The metallic core member may be made from a material selected from a group including steel, brass, aluminum, copper, tin and an alloy material.

BRIEF DESCRIPTION OF THE DRAWINGS

Some embodiments of the present invention will now be explained, with reference to the accompanied drawings, in which:

FIG. 7*a*, FIG. 7*b*, FIG. 7*c* and FIG. 7*d* all show the headband of FIG. 1, and FIG. 8*a*, FIG. 8*b*, FIG. 8*c* and FIG. 8*d* show four different users, these figures together further illustrate the limited adjustability of the headband of FIG. 1 in response to different contours of the users' head shapes;

DETAILED DESCRIPTION OF PREFERRED EMBODIMENTS OF THE INVENTION

Figure 1:
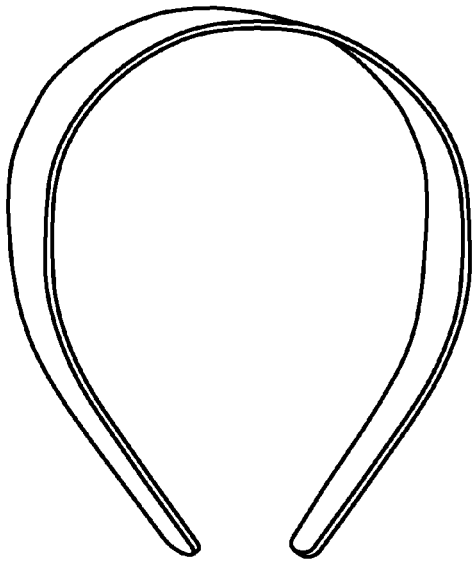
FIG. 1 is a front perspective view of a conventional headband.
Figure 2:
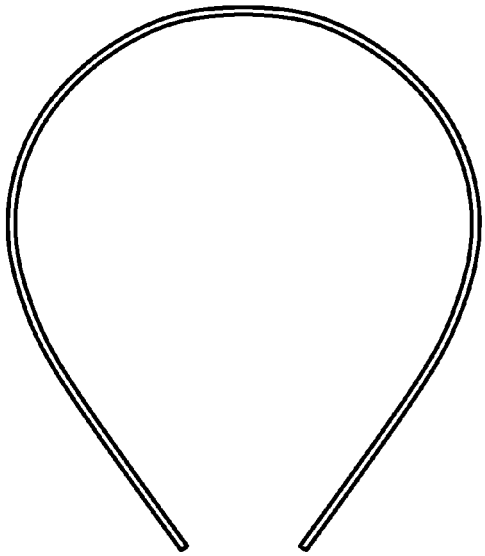
FIG. 2 is a front view of the headband of FIG. 1.
Figure 3:
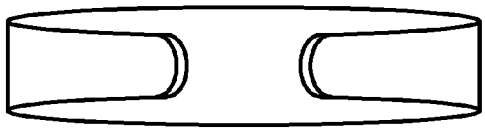
FIG. 3 is a view from below of the headband of FIG. 1 in normal use.
Figure 4B:
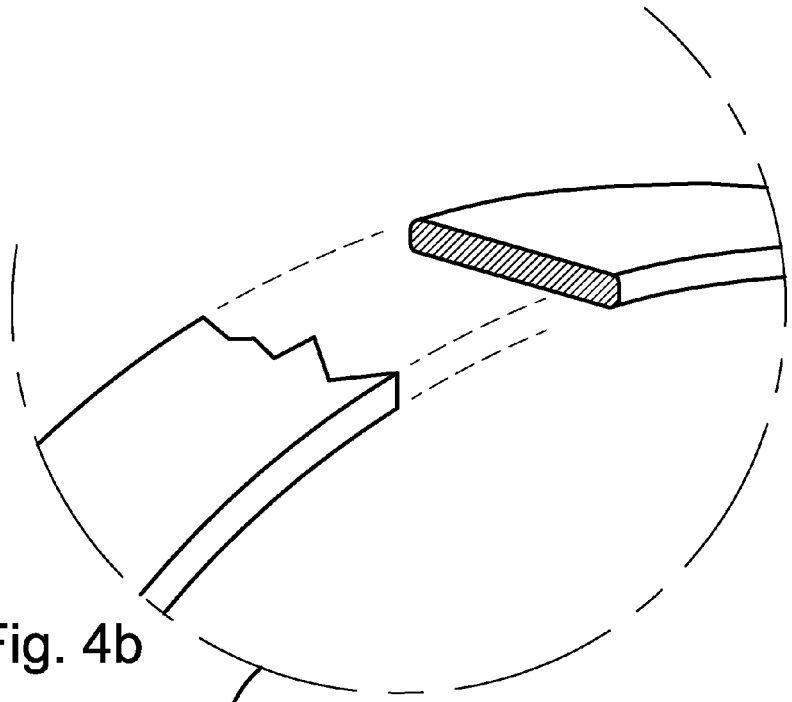
FIG. 4*b* is an enlarged view showing the broken section in FIG. 4*a;*
Figure 4A:
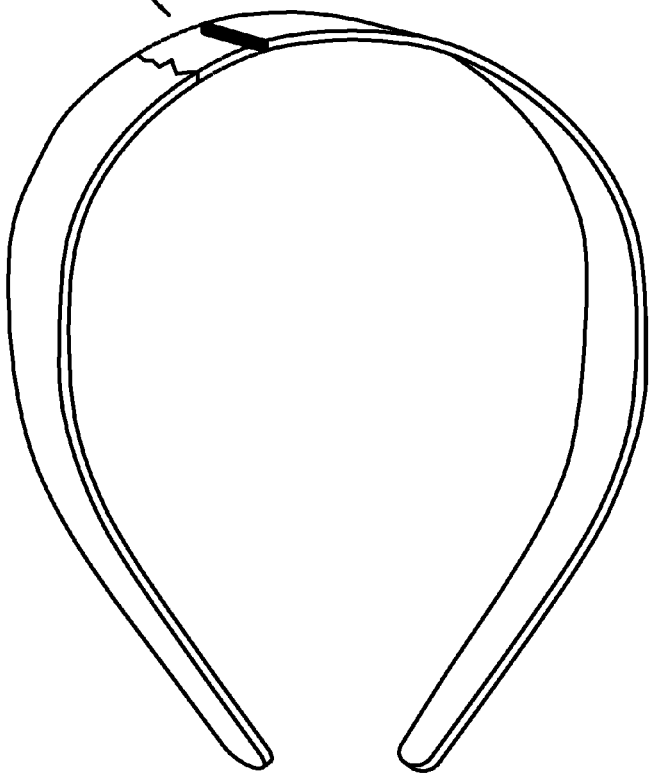
FIG. 4*a* is a front perspective view of the headband of FIG. 1, but with a broken section showing interior structure thereof.

One particular type of hair management accessory is conventional headband. Please see FIGS. 1 to 3. Such conventional headband is usually relatively simple in construction and made of essentially a polymeric material. Please see FIGS. 4*a* to 4*b*. The headband has a middle portion with two legs depending from the middle portion and generally resembles an arch. The legs have lower ends which are intended to secure hair at or around side burn areas of the user's head, upper ends which are intended to secure hair above side burn areas of the user's head, and top portion which is intended to secure hair on top of the head. Due to the inherent stiffness and resilience of the headband made of the polymeric material, at default the legs are biased, and positioned relatively close to, each other.

Figure 5:
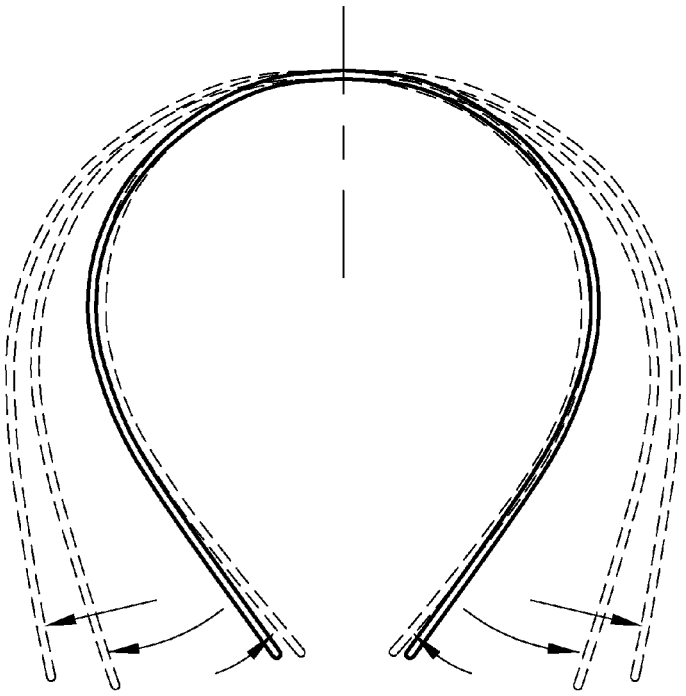
FIG. 5 is a front view of the headband of FIG. 1, showing limited adjustability thereof.
Figure 6:
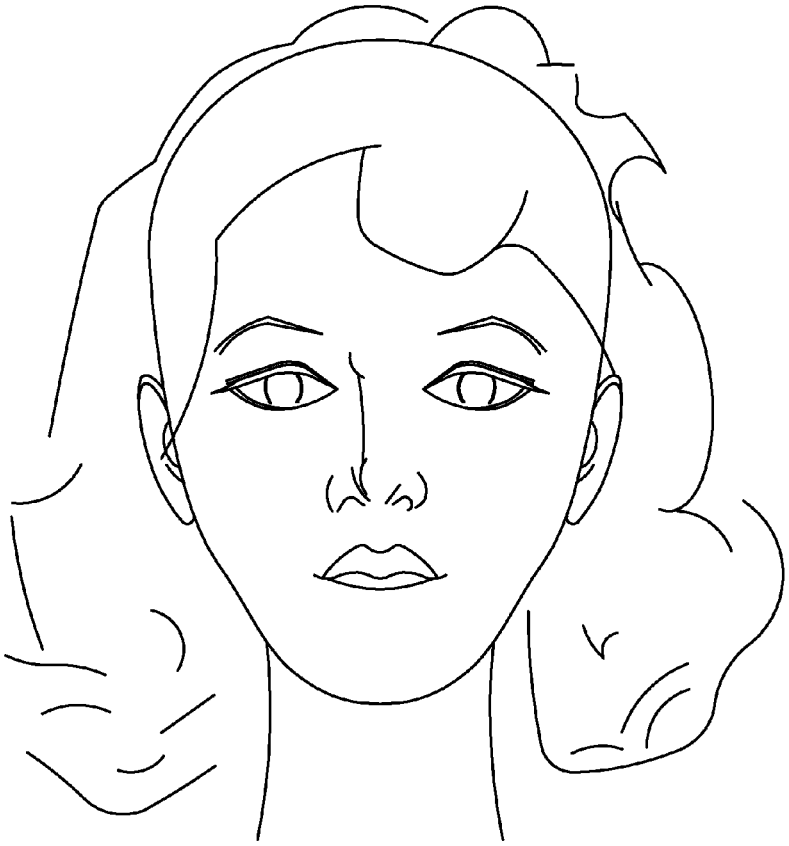
FIG. 6 shows the head of a user of the headband of FIG. 5.

FIG. 5 shows the headband that can assume the default configuration, or in one of expanded configurations in which the legs are moved apart to one of a number of positions. However, despite the legs can be moved apart to any one of the positions, a user may still find that the headband does not fit well regardless of which of the expanded configurations it assumes. Please see FIG. 6. This is because none of the expanded configurations would confirm to the particular curvature of the user's head. This is further explained in following paragraphs.

FIG. 7*a* shows the headband in one of the configurations when worn by a user in FIG. 8*a*. This user has a head shape in which upper portion of the head (with respect to middle portion thereof) is relatively wide. Due to the relatively wide upper portion of this user's head, the legs of the headband are to be spread sufficiently apart to allow enough room to fit the upper portion of the head. However, this user has a head shape in which opposite sideburn regions of the head are relatively close together. Thus, as shown in FIG. 8*a*, lower ends of the legs of the headband do not engage with the sideburn regions of the head. It is because the wider upper portion of the head has kept the lower ends of the legs apart or excessively apart. The behavior of the headband in this scenario leads to at least two undesirable effects. First, pressure from the headband tends to concentrate on the wider upper portion of the head. This often induces a sense of discomfort or even headache when the headband is worn for a prolonged period of time. Second, since the lower ends of the legs of the headband do not engage at the opposite sideburn regions of the head, the headband fails to manage and secure the hair in those regions.

FIG. 7*b* shows the headband in another one of the configurations when worn by a different user. This user has a different head shape in which the upper portion of the head is relatively narrow. In other words, the opposite side burn regions of the head are relatively far apart. Due to the relatively wide middle portion of this user's head, while the lower ends of the legs of the headband can engage the side burn areas of the user and thus secure and manage hair thereat well, the upper ends of the legs fail to engage the user's head well. The behavior of the headband in this scenario also leads to at least two undesirable effects. First, pressure from the headband tends to concentrate on the side burn areas of the head. This often induces a sense of discomfort or even headache when the headband is worn for a prolonged period of time. Second, since the upper ends of the legs of the headband do not sufficiently engage the head, the headband fails to manage and secure the hair in those regions. As shown in FIG. 8*b*, there are actually gaps between the headband and the user's head.

FIG. 7*c* shows the headband in another one of the configurations when worn by a different user. This user has a head shape in which the distance from the top of the head and the chin (with respect to the shape of the headband) is relatively small. In other words, the user has a relatively "short" head. Due to the relatively wide and short of the user's head with respect to the headband, while the lower and upper ends of the legs of the headband can engage opposite side of the user's head well, and thus secure and manage hair thereat well, the middle region of the headband fails to engage the top of the head well. The behavior of the headband in this scenario also leads to at least two undesirable effects. First, pressure from the headband tends to concentrate on the opposite sides of the head. This often induces a sense of discomfort or even headache when the headband is worn for a prolonged period of time. Second, since the middle region of the headband does not engage the top of the head, the headband fails to manage and secure the hair in that region. As shown in FIG. 8*c*, there is actually a gap between the headband and the user's head.

FIG. 7*d* shows the headband in another one of the configurations when worn by a different user. This user has a head shape which is somewhat similar to that of the user in FIG. 8*b*. Similarly, due to the relatively large distance between the user's side burn regions, the legs of the headband are to be spread sufficiently apart. As a result, the upper regions of the headband are likewise spread relatively far apart, such that the upper regions do not engage the regions above side burn regions of the head. The behavior of the headband in this scenario leads to two undesirable effects similar to those illustrated in FIG. 8*b*. As shown in FIG. 8*d*, there are actually gaps between the headband and the user's head in use. Hair in the gap regions is loose and not firmly secured.

Figure 9B:
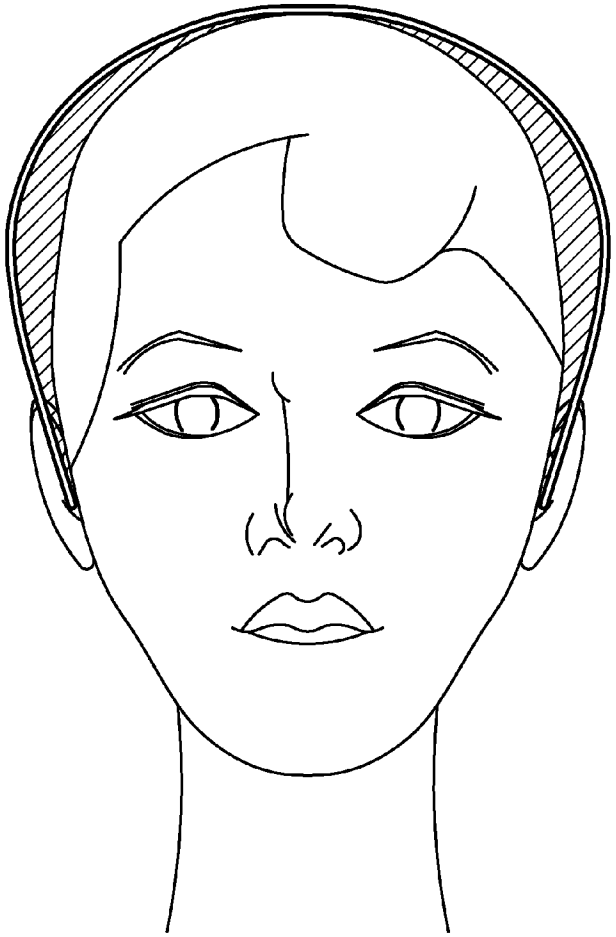
FIG. 9*a*, FIG. 9*b*, FIG. 9*c* and FIG. 9*d* similarly and schematically illustrate the limited adjustability of the headband of FIG. 1 in response to different contours of the users' head shapes.
Figure 9A:
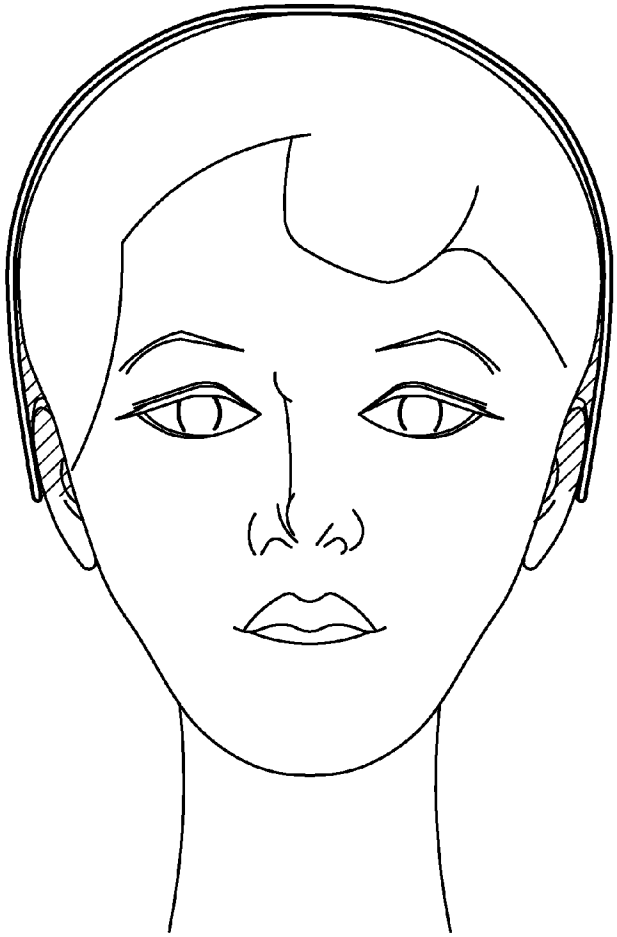

FIG. 9*a* is a schematic diagram corresponding to FIG. 8*a*. The shading lines refer to the regions (at side burns) or gaps where the headband does not engage with the head of the user such that hair at those regions is not managed or secured as intended.

FIG. 9*b* is a schematic diagram corresponding to FIG. 8*b*. The shading lines refer to the regions (above side burn) or gaps where the headband does not engage with the head of the user such that hair at those regions is more not or secured as intended.

Figure 9D:
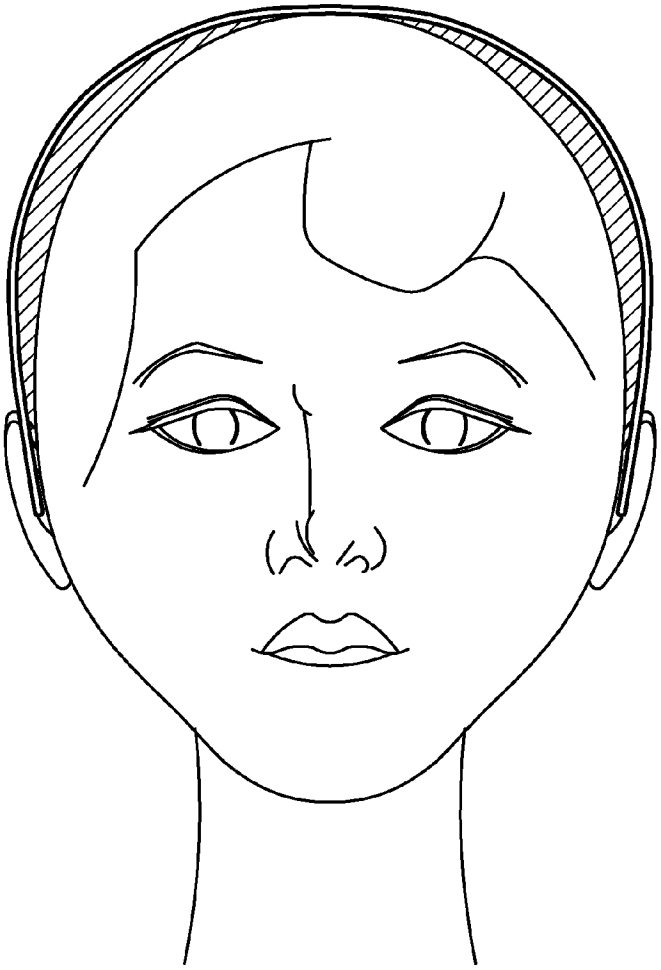
Figure 9C:
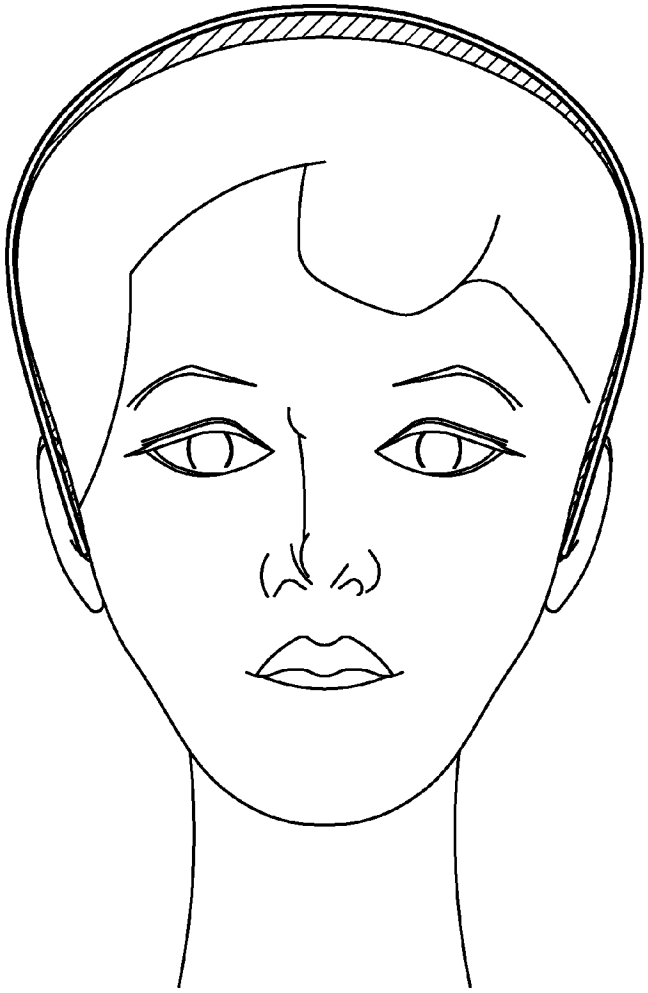

FIG. 9*c* is a schematic diagram corresponding to FIG. 8*c*. The shading lines refer to the region (top of the head) or gap where the headband does not engage with the head of the user such that hair at that region is not managed or secured as intended.

FIG. 9*d* is a schematic diagram corresponding to FIG. 8*d*. The shading lines refer to the regions (above side burns) or gaps where the headband does not engage with the head of the user such that hair at those regions is not managed or secured as intended.

As illustrated above, such conventional headband, despite limited extent of adjustability, does not conform to varieties of head shapes of different users. This is because the adjustability and possible configurations of conventional headband is determined and limited by the inherent one default shape and the particular polymeric material used. It cannot tailor or adjust to different head shapes or configurations of different users. It is to be understood that for the purpose of this invention, by conforming to head shapes it does not refer a headband merely contacting hair of a user in use. Instead, it refers to the capability of the headband to engage to the head by programming the headband such that it follows the shape of the skull of the head.

Figures 10A, 10B, 10C, 10D, 10E:
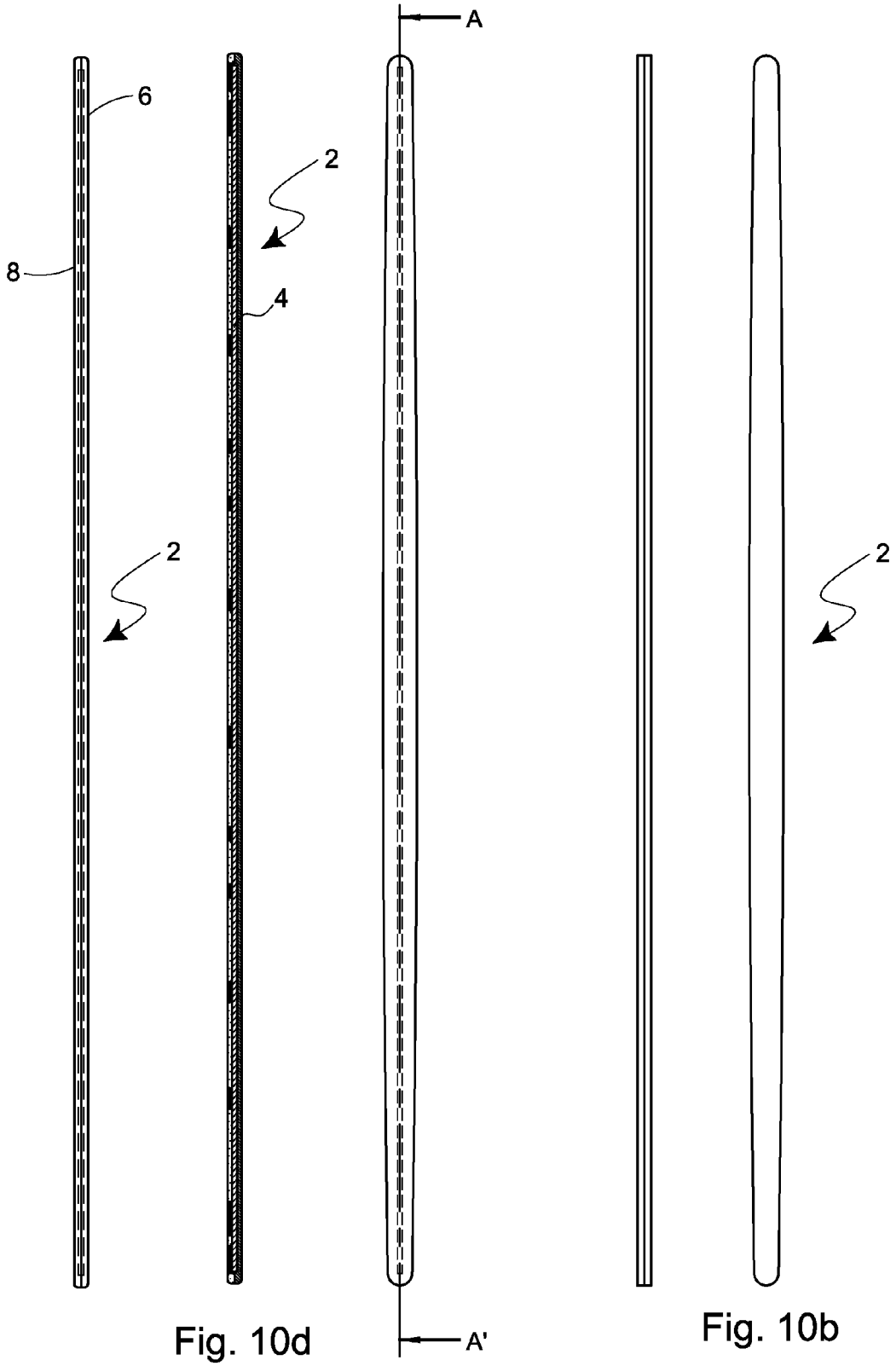
FIG. 10*b* is a view of an embodiment of a headband in a straightened configuration according to the present invention.
FIG. 10*a* is a side view of the headband of FIG. 10*b;*
FIG. 10*c* is a schematic diagram of the headband showing further structural details of the headband of FIG. 10*b;*
FIG. 10*d* is a section view of the headband of FIG. 10*c* taken along line A-A'.
FIG. 10*e* is a schematic diagram the headband of FIG. 10*b* but also showing presence of a member between two layers.

FIG. 10*a* is a side view of an embodiment of a headband 2 according to the present invention. FIG. 10*b* is a plan view showing an externally facing surface of the headband 2 in normal use. FIG. 10*c* is a schematic view showing the presence of a metallic wire 4 in a cavity in the headband. The wire 4 acts as a core of the headband 2. FIG. 10*d* is a cross section view of the headband 2 taken at A-A' in FIG. 10*c*. FIG. 10*e* is a schematic view showing the metallic wire 4 sandwiched by an outwardly facing portion 6 and an inwardly facing portion 8. By inwardly facing portion 8, it means it faces and engages the head/hair of a user in use. The outwardly facing portion 6 defines the externally facing surface in normal use.

Figure 11:
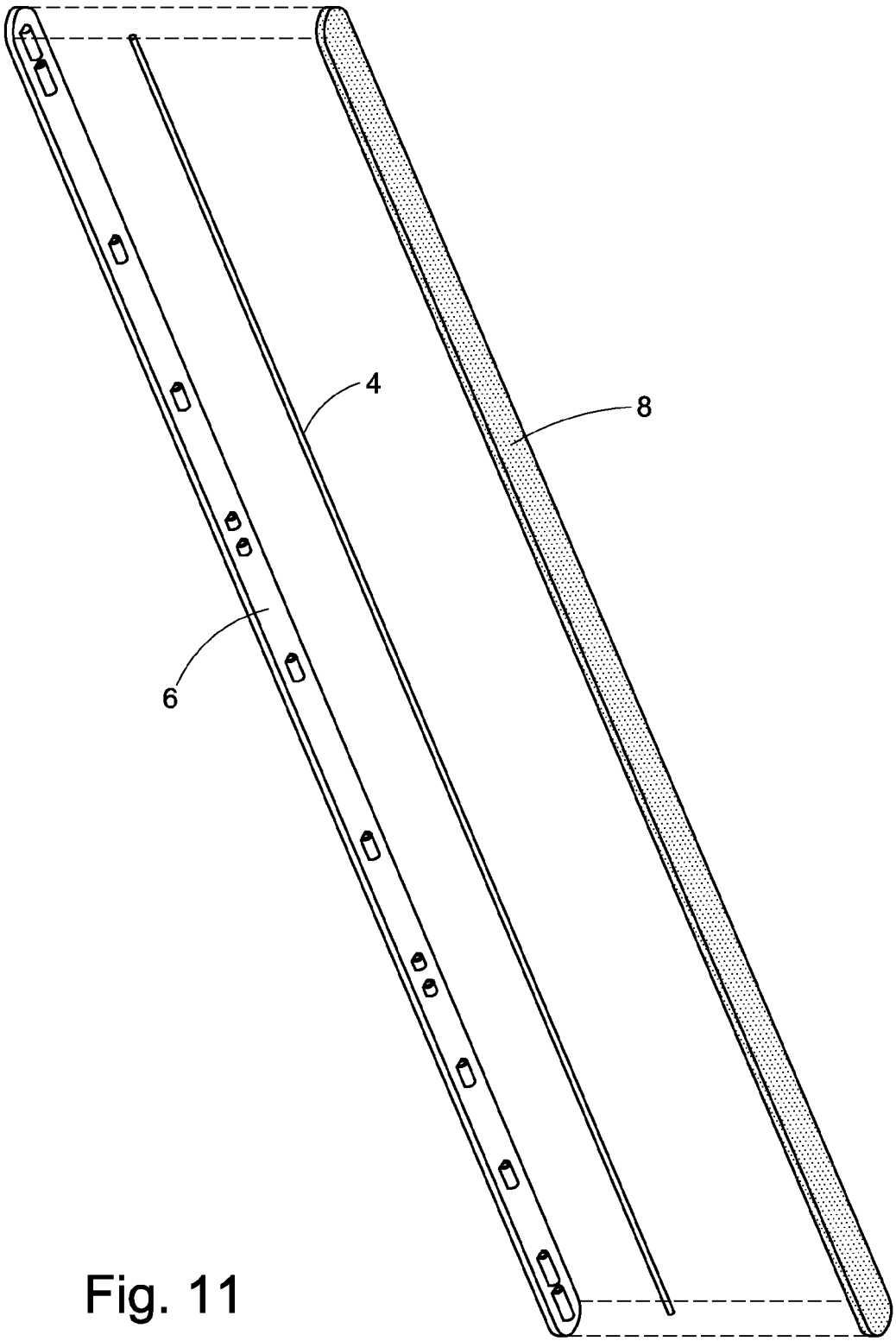
FIG. 11 is a schematic diagram showing an exploded view of the headband of FIG. 10*b;*

FIG. 11 is an exploded view showing the outwardly facing portion 6, the metallic wire 4 and the inwardly facing portion 8. The outwardly facing portion 6 is in the form of a layer and an elongate member. The length of the elongate member preferably is from 320-400 mm.

Figures 12, 13:
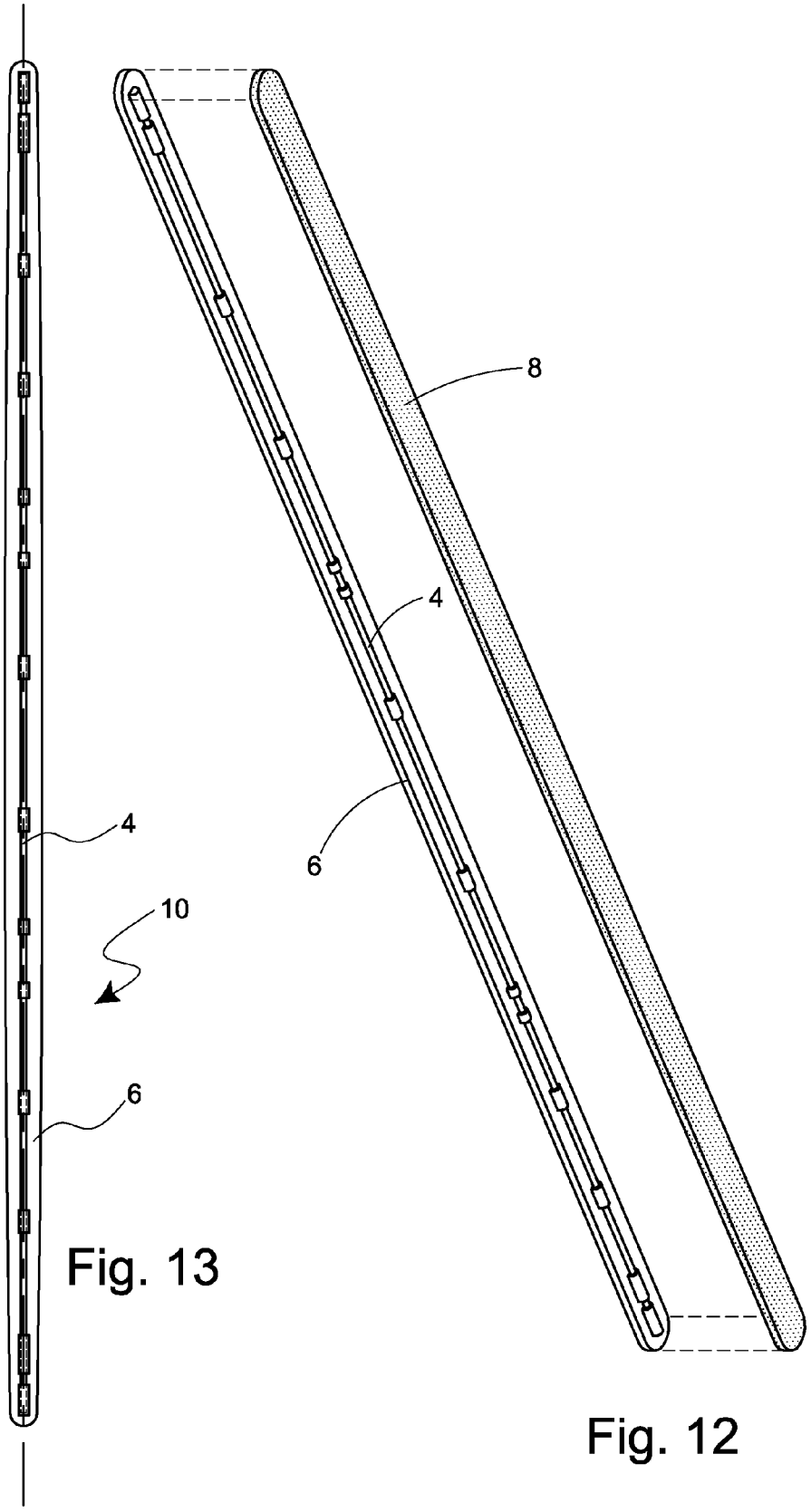
FIG. 12 is a diagram similar to FIG. 11 but showing the headband in a semi-assembled stage.
FIG. 13 is a schematic diagram similar to part of FIG. 12 showing the view from above the semi-assembled headband.

FIG. 12 shows a first assembly 10 of the outwardly facing portion 6 and the metallic wire 4. The inwardly facing portion 8 also in the form of a layer and the first assembly together form a second assembly 12 which together form the headband 2. FIG. 13 similarly is a plan view showing the first assembly 10.

Figure 14:
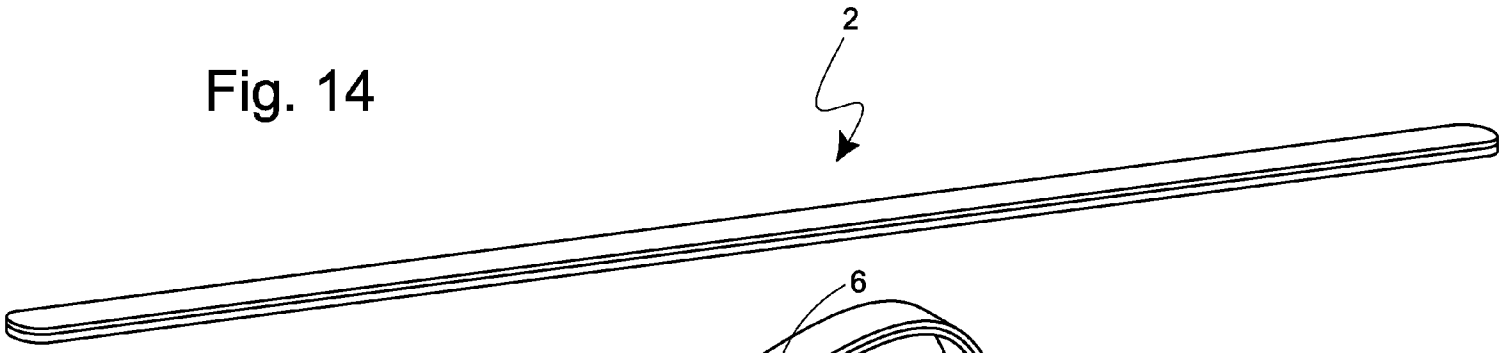
FIG. 14 is a perspective view of the headband of FIG. 10*b;*

FIG. 14 is perspective view of the headband 2 in a straightened configuration. It is shown that the headband has two layers, namely a top layer portion or the outwardly facing portion 6 and a second layer or the inwardly facing portion 8 connected together. In this embodiment, the outwardly facing portion 6 is made from essentially polypropylene (PP). Studies have shown that materials selected a group of acrylonitrile butadiene styrene (ABS), polypropylene (PP), polyethylene (PE), nylon, polycarbonate (PC), acrylonitrile styrene (AS), polyoxymethylene (POM), general purpose polystyrene (GPPS), high impact polystyrene (HIPS), acrylic, cellulose acetate and thermoplastic elastomer (TPE) are also workable material. The inwardly facing portion 8 may be made from a second material selected from the group including thermoplastic elastomer (TPE), thermoplastic polyurethane (TPU), polyurethane (PU), silicone, natural rubber and ethylene vinyl acetate (EVA). Although various materials may be used to make the metallic member, studies have shown that steel, brass, aluminum, copper, tin or an alloy material is particularly suitable. These materials are not chosen arbitrarily. Only materials with certain material characteristics like these materials would deliver functionalities required in the present invention.

Figure 15:
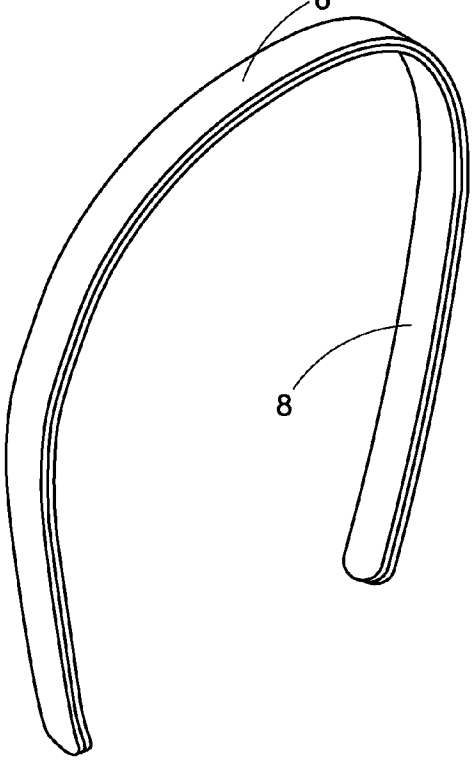
FIG. 15 is a perspective view of the headband of FIG. 14 but in an arched configuration.

FIG. 15 is a perspective view of the headband 2 in a curved or bent configuration.

Figures 16A, 16B, 16C:
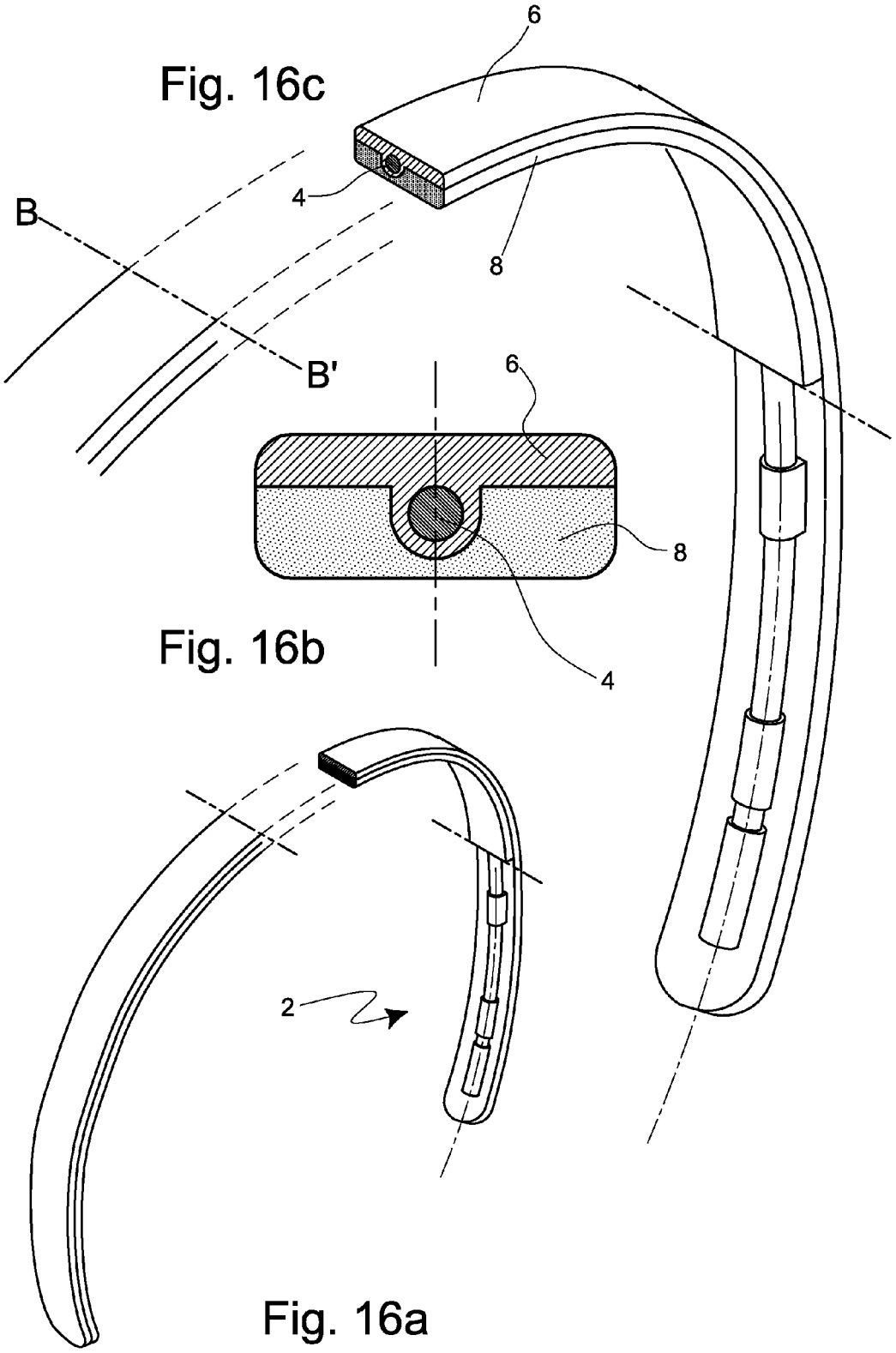
FIG. 16*a* is similar to FIG. 15 but showing more structural details of the headband.
FIG. 16*b* is a cross section view taken along line B-B' of FIG. 16*a;*
FIG. 16*c* is similar to FIG. 16*a* but showing the headband enlarged for further illustration.

FIGS. 16*a-c*illustrate interior structure of the headband 2.

Figures 17, 18:
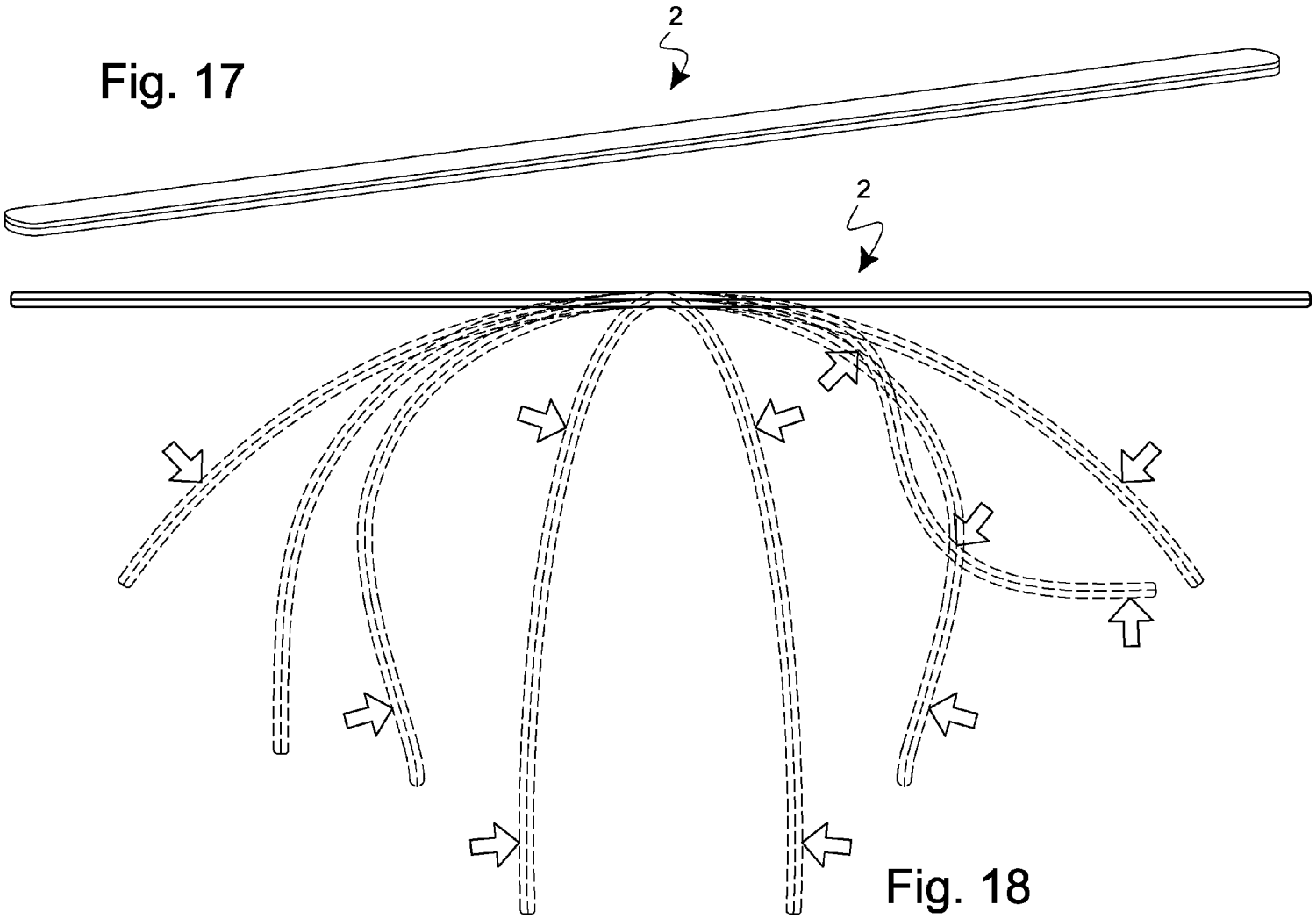
FIG. 17 is a perspective view of the headband of FIG. 10*a;*
FIG. 18 is the headband of FIG. 17, illustrating unlimited user adjustability.
Figure 19A:
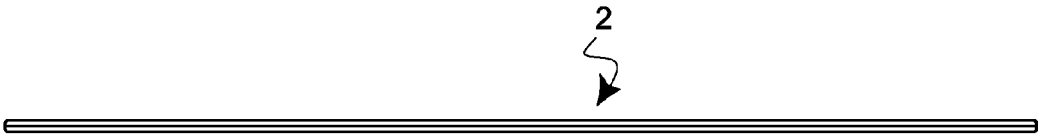
FIG. 19*a* is a side view of the headband of FIG. 10*a*, and FIGS. 19*b* to 19*e* illustrate different configurations assumable by the headband.
Figure 19B:
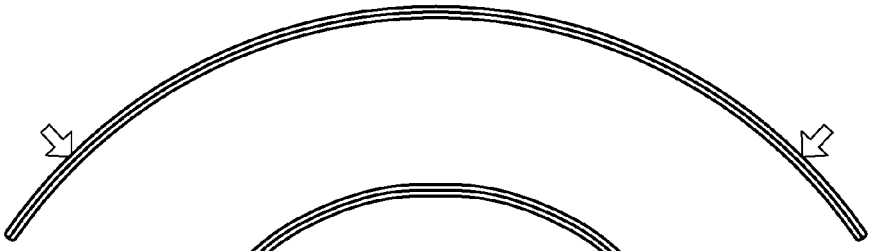
Figure 19C:
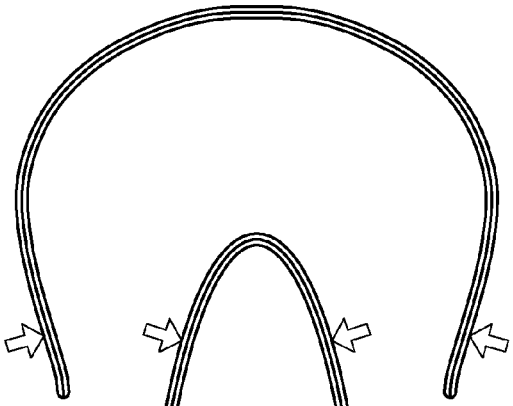
Figure 19D:
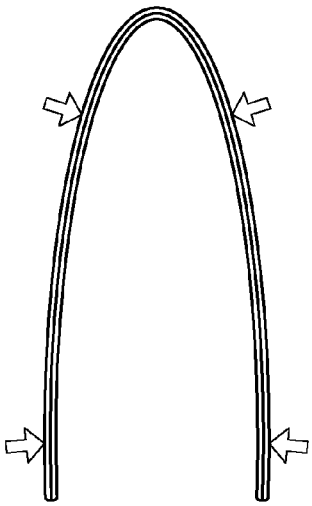
Figure 19E:
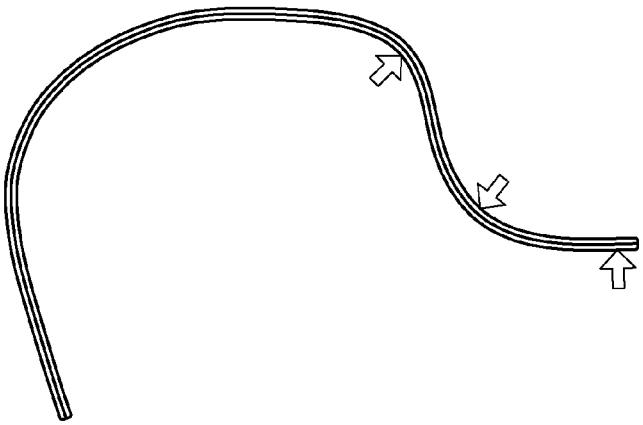

FIGS. 17-18 illustrate how the headband 2 is programmed to take a shape desired by a user. The particular shape is tailored to follow the curvature of the skull of the user. As can be seen from FIG. 18, the possibilities of configurations of the headband 2 are not limited to just arch configurations. Please compare the novel headband 2 in for example FIG. 18 and the conventional headband in for example FIG. 5. Specifically, some configurations of the novel headband 2 could not be achieved by the conventional headband shown in FIG. 5.

FIG. 19*a-e*further illustrate numerous possible configurations achieved by headband 2.

One characteristic of the headband 2 that contributes to its capability to conform to the shape of the skull of the head of a user is that the user of the outwardly facing portion is made of one material and the wire portion made of a different material. While different combinations of materials may be used, research and studies leading to the present invention show that the material of the outwardly facing portion should preferably have a flexural strength from substantially 36-72MPa, and the material of the metallic wire should preferably in the range of substantially 560-930MPa. With the use of a combination of two different materials with different flexural strengths for the different portions, the headband can not only change configuration and shape, but also follow the contour of the skull of the user's head for managing and securing hair of the head along the length of the headband and yet stiffness and resilience of the headband is sufficiently retained. Since the particular shape or configuration of the headband is not merely determined by the elasticity of one material making the headband, and the conforming curvature of different regions along the headband can be tailored, one such headband can be programmed differently to fit different head shapes of a wide variety of users.

It is to be understood that due to resilience, material characteristics and flexural strength of the outwardly facing portion, in use the legs of the headband has a tendency to spread apart. At the same time, due to different resilience, material characteristics and flexural strength of the metallic wire 4, in use it has a tendency to keep the legs closer together as programmed by the user. In other words, there are two competing forces in opposite directions from the outwardly facing portion and the metallic wire 4 going on at the same time. The presence of these forces contributes to improved fit and comfort of the headband.

During the course leading to the present invention, among other workable embodiments two specific embodiments of headbands according to the present invention were made. One workable embodiment was made with the outwardly facing portion and metallic wire portion having flexural strengths of 48 MPa and 740 MPa, respectively. Another workable embodiment was made with the outwardly facing portion and metallic wire portion having flexural strengths of 58 MPa and 740 MPa, respectively.

The inwardly facing portion of the headband plays relatively little role in the conformability of the headband. As long as inwardly facing portion be made from a material substantially less stiff than that of the second layer material, or with a very low and significantly lower flexural strength, the material would be appropriate. One main role of the inwardly facing portion is to provide a layer to close the first assembly. Another role of the inwardly facing portion is to provide anti-slipping surface for engagement to the hair and thus to minimize the headband from slipping out of position in use.

FIG. 20 and FIGS. 20*a-d*illustrate the capability of the headband 2 to confirm to the different shapes of skulls of different users, and the way the headband works.

Figures 20, 20A, 20B, 20C, 20D:
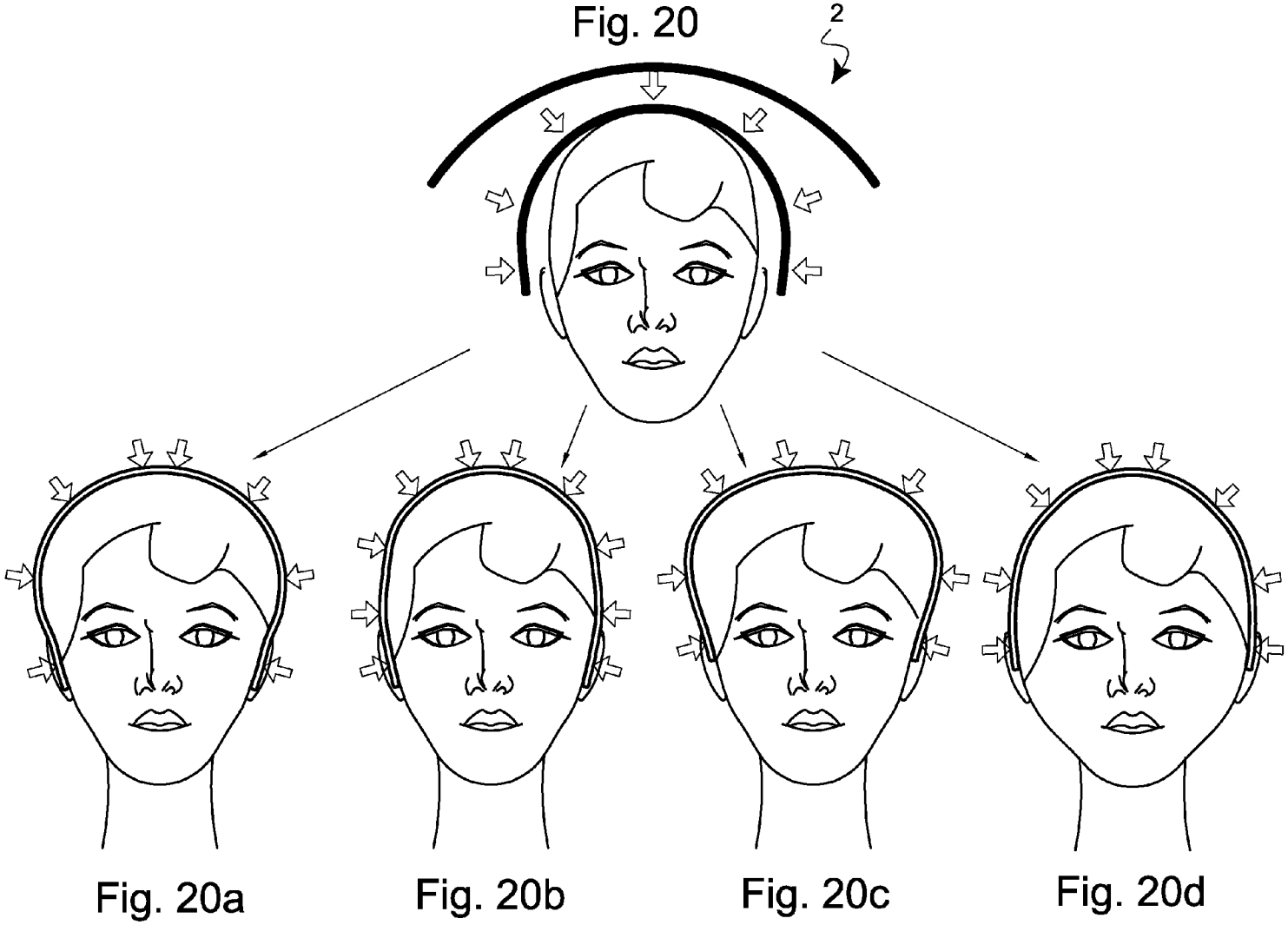
FIG. 20 is a schematic diagram showing a user is about to wear the headband of FIG. 10*a;*
FIGS. 20*a* to 20*d* illustrate user adjustability of the headband of FIG. 10*a* to suit different contours of different users' heads.

Referring to FIG. 20 and FIG. 20*a* as an example, when a user acquires the headband, it may come in a straightened configuration as shown in FIG. 20. The user then adjusts the headband by placing the headband around the head. Once this is done, due the plurality of flexural strengths of different portions of the headband, it is able and can be programmed to memorize its new default configuration. In other words, the default configuration is user-determined. Please see FIG. 20*a*. The headband in this new default configuration can fit around the skull of the user. The novel headband is different in that while it can manage and secure hair of the user, it would not leave uneven or excessive gaps between the headband and the hair or skull, or at least it would not create excessive or inadequate pressure on different regions of the head surrounded by the headband.

FIGS. 20*b-d*show three other different users with three different head shapes. Still with the novel headband once it is programmed it can assume a new default configuration.

Figure 21B:
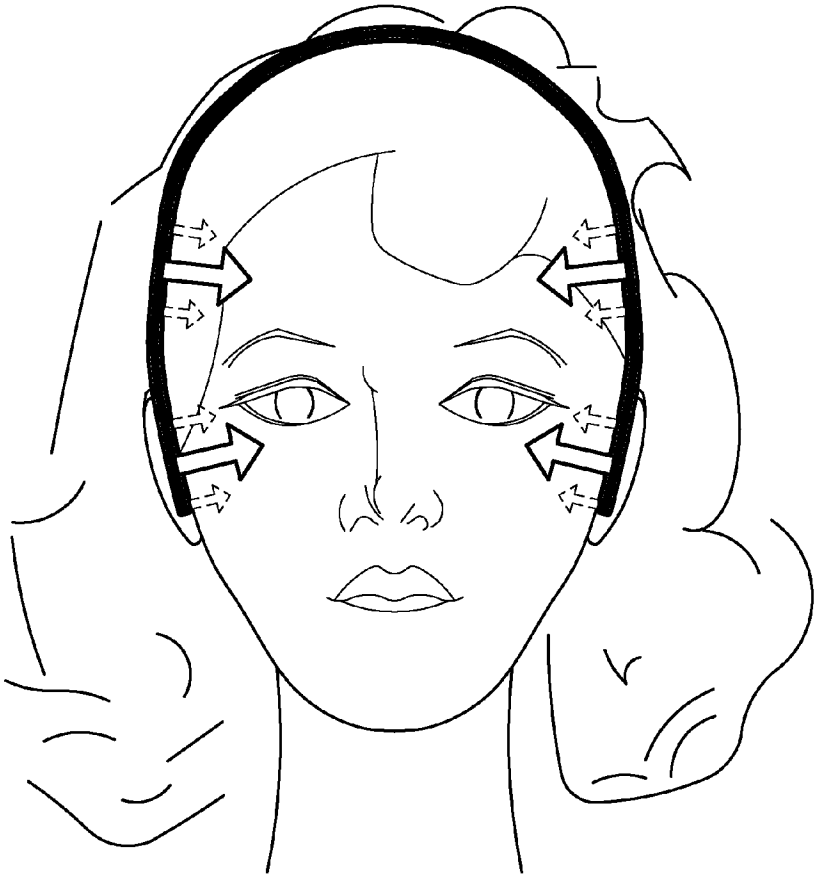
FIG. 21*a* illustrates the use of a conventional headband of FIG. 1 by a user and FIG. 21*b*, comparatively, illustrates the use of the novel headband of FIG. 10*a* by the same user.
Figure 21A:
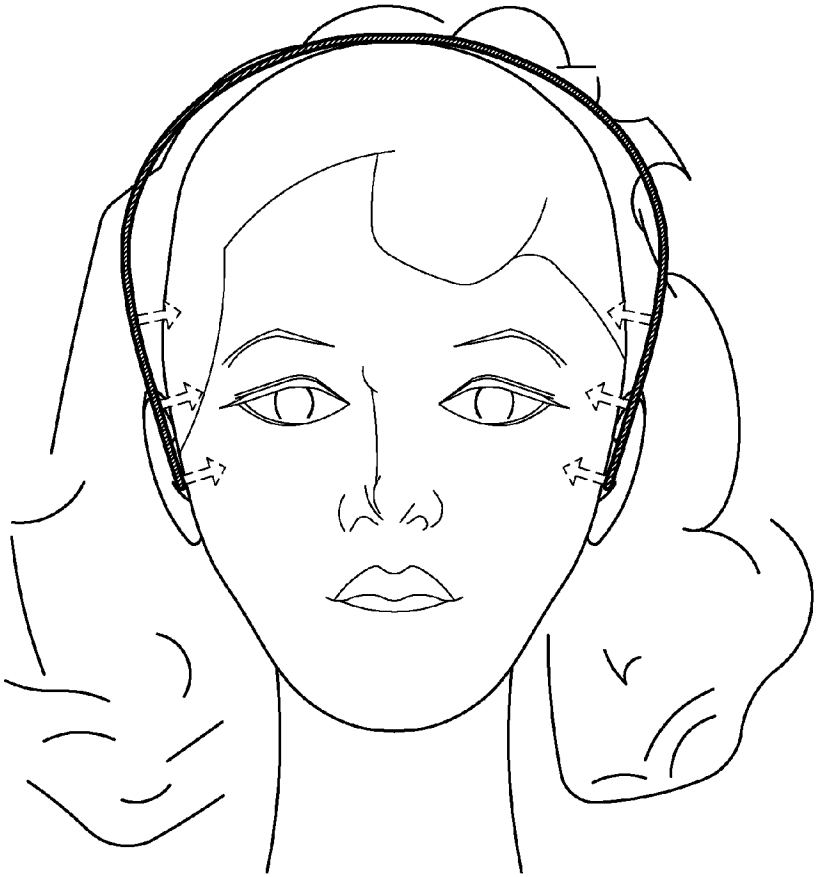

FIG. 21*a* is a schematic diagram showing a conventional headband worn by a user. It be seen from this figure that there are regions on the head surrounded by the headband at which the headband provides inadequate pressure to secure hair, and there are also regions or pressure points on the head (around side burn areas) taking excessive squeezing or pressures from the headband, as indicated by the arrows in the figures. Users of conventional headbands often complain about excessive pressure from the headband on the sideburn areas or around the ears, causing discomfort or headache. For comparison purpose, FIG. 21*b* is a schematic diagram showing the novel headband. There is no uneven gap between the headband and the head of the user such that hair can be reliably secured. The pressure from the headband is also even disturbed around and exerted on the head, as indicated by the arrows in the figures.

Figures 22A, 22B:
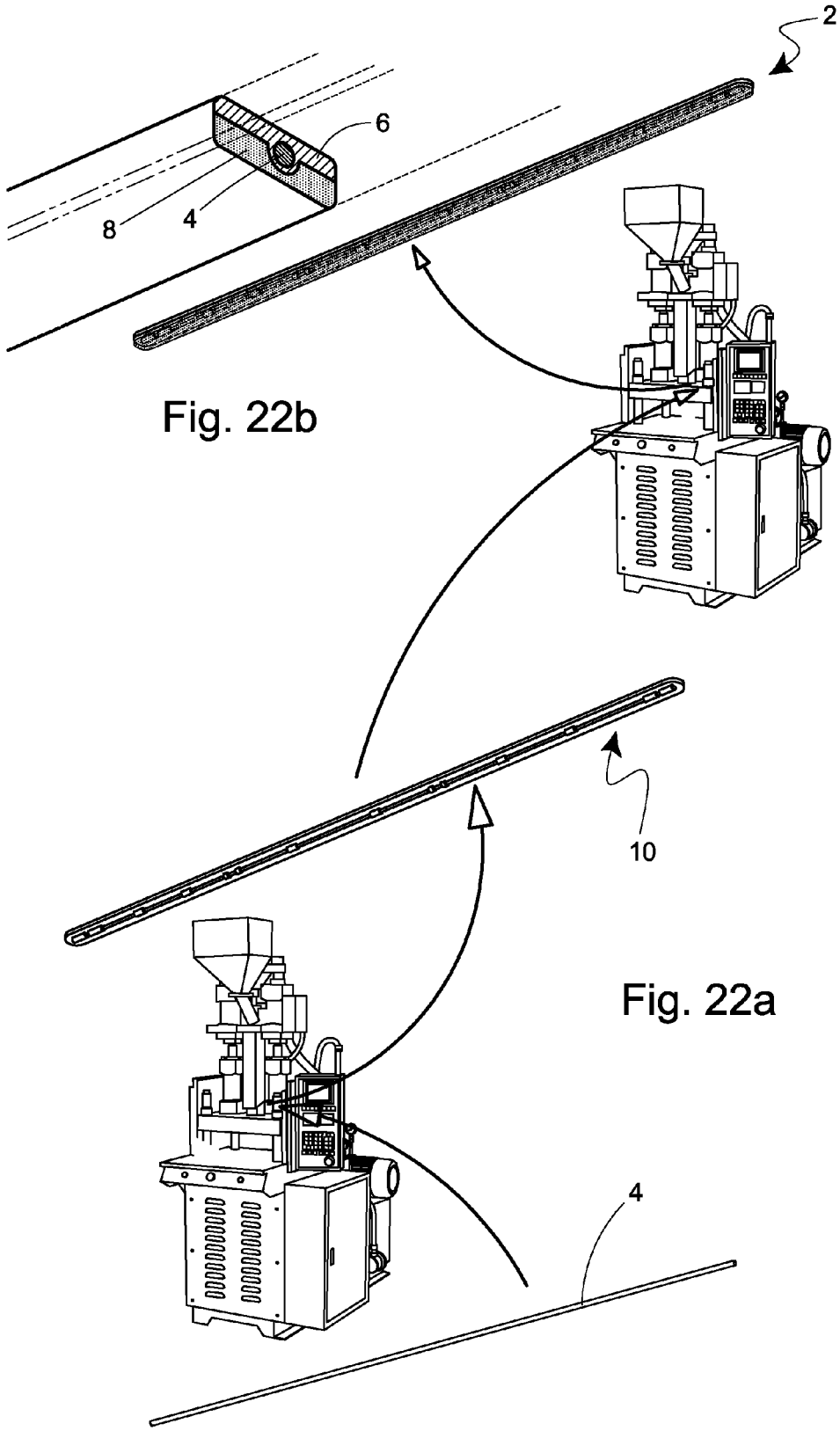
FIGS. 22*a* to 22*b* illustrate an embodiment of method of manufacture of a headband according to the present invention.

One embodiment of a method of manufacture of a headband according to the present invention is to provide an elongate metallic core member, for example one described above. The elongate metallic core member is then positioned in a mould in a moulding machine. The elongate metallic core member can be overmoulded (for example, on top) with a first material on the elongate metallic core member for forming the first assembly of a first layer portion and the metallic core member. It is envisaged that the first assembly defines a first surface and a second surface. Please see for example FIG. 13 and FIG. 22*a*.

The first assembly is then overmoulded with a second material (in the same or in a different moulding machine) on the elongate metallic core member and on the second surface over the metallic core member for forming a second assembly. The second assembly includes the first layer portion, the metallic core member and a second layer portion. The second assembly defines a third surface acting to engage the head/hair of the user in use. In use, the first surface acts as an outwardly facing surface of the headband in use, and the second assembly defines the third surface acting as inwardly facing surface of the headband.

In an alternative embodiment, instead of overmolding the first material to the metallic core member, the first assembly may be formed by connecting the metallic core member and the first layer portion adhesively. Then the second assembly may be formed by connecting the first assembly and the second layer portion adhesively, or by moulding the second material over the metallic core member or wire.

A person skilled in the art on reading the above will understand that a headband according to the present invention may assume a first or substantially straightened configuration at the time it has been manufactured. When a user acquires the headband, the headband in the first configuration is initially adjusted by bending it into a desired curvature such that it assumes a second or arched configuration. This is achieved by bending the headband to conform to the shape of the user's head. After the headband is adjusted to fit the shape of the user's head, the user would further adjust the headband such that it assumes a third configuration in which the legs of the headband are brought slightly closer together. Once the headband achieves this third configuration, the headband has been programmed and resilience or memory of the headband will bias the legs to move towards this biased and closer state by default. It is this resilience or memory of the headband that achieve the hair holding capacity for the user.

It should be understood that certain features of the invention, which are, for clarity, described in the content of separate embodiments, may be provided in combination in a single embodiment. Conversely, various features of the invention which are, for brevity, described in the content of a single embodiment, may be provided separately or in any appropriate sub-combinations. It is to be noted that certain features of the embodiments are illustrated by way of non-limiting examples. Also, a skilled person in the art will be aware of the prior art which is not explained in the above for brevity purpose.

The invention claimed is:

1. A headband for managing hair of a user comprising an elongate, U-shaped body member defining a full length and configured to be conformable around the head of a user, wherein the body member includes, along the full length of the headband, a first layer potion with a flexural strength from substantially 36-72 MPa, a second layer portion connected to the first layer portion, and a third layer portion, and an elongate metallic core member with a flexural strength from substantially 560-930 MPa and sandwiched between the first and second layer portions, the first layer portion and the second layer portion fixedly connected together along full length of the headband by overmoulding and/or adhesively and made of different materials with different physical properties and extending substantially along the full length of the elongate body member, wherein the first layer portion is made from a material substantially stiffer than that of the second layer material, whereby as a result of combination of the different physical properties of the first layer portion and the second layer portion connected together along the full length, and the metallic core member sandwiched between the first and second layers, when the headband resembling an arch is worn by the user, the first layer portion is positioned to be outwardly facing and the second layer is positioned to be inwardly facing, the body member is i) user-adjustable in curvature such that the full length of the arch is bendable to conform to specific contour of the head and entire inwardly facing surface of the second layer portion of the member is engageable around the head and ii) the headband, in addition to bendability, is also programmable to memorize a new default configuration for the user or each new user.

2. A headband as claimed in claim 1, wherein the headband is configured to allow the user to program the elongate member such that magnitude of pressure from different regions of the full length of the body member on the head is user-adjustable.

3. A headband as claimed in claim 1, wherein the body member has a length from substantially 320 to 400 mm.

4. A headband as claimed in claim 3, wherein the body member has a length from substantially 320-360 mm.

5. A headband as claimed in claim 1, wherein the first layer portion is made from a first material selected from the group consisting of acrylonitrile butadiene styrene (ABS), polypropylene (PP), nylon, polycarbonate (PC), acrylonitrile styrene (AS), polyoxymethylene (POM), general purpose polystyrene (GPPS), high impact polystyrene (HIPS), acrylic and cellulose acetate.

6. A headband as claimed in claim 1, wherein the second layer portion is coated with the third layer portion being an anti-slipping material for enhancing gripping of hair in use.

7. A headband as claimed in claim 1, wherein the second layer is made from a second material selected from the group consisting of and ethylene vinyl acetate (EVA).

8. A headband as claimed in claim 1, wherein the metallic core member be made from a material selected from a group including steel, brass, aluminum, copper, tin and an alloy material.

9. A method for manufacture of a headband as claimed in claim 1, comprising steps in sequential order of:

a) providing the elongate metallic core member;

b) positioning the elongate metallic core member on a mould in a moulding machine;

c) overmoulding a or the first material on the elongate metallic core member for forming a first assembly of the first layer portion and the metallic core member, the first assembly defining a first surface acting as an outwardly facing surface of the headband in use and a second surface; and d) overmoulding a or the second material on the elongate metallic core member on the second surface over the metallic core member for forming a second assembly of the first layer portion, the metallic core member and the second layer portion such that the metallic core member is sandwiched by the first material and second material, and the first material, the second material and the metallic core member extending along substantially full length of the second assembly, the second assembly defining a third surface acting as the inwardly facing surface of the headband in use;

wherein the first material and the second material sandwiching the metallic core member are different materials along a full length of the headband in that the first layer portion is made from a material substantially stiffer than that of the second layer material, whereby as a result of combination of different physical properties of the first layer material, the second layer material and the metallic core member at a cross section of any region along substantially full length of the headband body member of the headband is user-adjustable in curvature in order to allow arch of the headband be conformable to specific contour of a user's head and entire inwardly facing surface of the second layer portion of the member be engageable around the head.

10. A method as claimed in claim 9, wherein the steps of overmoulding the first material and overmoulding the second material occurs in one moulding machine.

11. A method for manufacture of a headband defining a U-shaped body member, comprising steps in sequential order of:

a) providing an elongate metallic core member;

b) connecting the metallic core member and a first layer portion together thus forming a first assembly, the first assembly defining a first or outwardly facing surface and a second surface and having a length from substantially 320 to 400 mm, the first layer portion made of a first material;

c) connecting the first assembly and a second layer portion thus forming a second assembly, the second assembly defining a third surface acting an inwardly facing surface; wherein:

the second assembly forming a U-shaped body member is formed by positioning the first assembly in a mould, and overmoulding a second material different from the first material on the metallic core member for forming the second assembly such that by way of the overmoulding, the first layer portion and the second layer portion extending along the full length of the second assembly are fixedly connected along the full length of the second assembly, and the difference in material of the first and second layer portions and the metallic core member defining deformability and conformability of the headband along the full length of the second assembly; and said first layer portion has a flexural strength from substantially 36-72 MPa, and the metallic core member has a flexural strength from substantially 560-930 MPa.

12. A method as claimed in claim 11, wherein the first assembly is formed by positioning the metallic core member on a mould in a moulding machine and overmoulding a first material on the metallic core member for forming the first assembly.

13. A method as claimed in claim 11, wherein the first layer portion is made from a first material selected from the group consisting of acrylonitrile butadiene styrene (ABS), polypropylene (PP), polyethylene (PE), nylon, polycarbonate (PC), Acrylonitrile Styrene (AS), polyoxymethylene (POM), general purpose polystyrene (GPPS), high impact polystyrene (HIPS), acrylic and cellulose acetate.

14. A method as claimed in claim 11, wherein the second layer portion is made of an anti-slipping material for enhancing gripping of hair of user in use.

15. A method as claimed in claim 11, wherein the second layer is made from a second material selected from the group consisting of silicone and ethylene vinyl acetate (EVA).

16. A method as claimed in claim 11, wherein said metallic core member be made from a material selected from a group including steel, brass, aluminum, copper, tin and an alloy material.

* * * * *